US007404240B2

(12) United States Patent
Nedbal et al.

(10) Patent No.: US 7,404,240 B2
(45) Date of Patent: Jul. 29, 2008

(54) ZIPPER PULL WITH COVER MEMBER

(75) Inventors: Luciano Nedbal, Milan (IT); Mauro Ciccarelli, Milan (IT); Naoki Kondo, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/629,662

(22) Filed: Jul. 29, 2003

(65) Prior Publication Data

US 2004/0020017 A1 Feb. 5, 2004

(30) Foreign Application Priority Data

Jul. 31, 2002 (IT) ..... TO2002A0688

(51) Int. Cl.
*A44B 19/26* (2006.01)

(52) U.S. Cl. ..... 24/429; 24/415

(58) Field of Classification Search ..... 24/429, 24/419, 437, 430, 432; 70/68; 294/3.6
See application file for complete search history.

(56) References Cited

U.S. PATENT DOCUMENTS 1,988,761 A 1/1935 Towner
3,409,322 A * 11/1968 Albanese et al. ..... 294/3.6
3,965,706 A * 6/1976 Davis ..... 70/68
3,991,447 A * 11/1976 Akashi ..... 24/430
4,008,914 A * 2/1977 Anderson ..... 70/68
5,101,538 A 4/1992 Dieter
5,195,221 A * 3/1993 Kanamaru et al. ..... 24/429
6,209,176 B1 * 4/2001 Anscher ..... 24/429
6,499,200 B1 * 12/2002 Yamagishi et al. ..... 24/429
6,533,335 B2 * 3/2003 Hudson ..... 24/429

FOREIGN PATENT DOCUMENTS

| | | |
|---|---|---|
| EP | 1 088 490 | 4/2001 |
| FR | 2 248 801 | 5/1975 |
| JP | 42-10707 | 6/1967 |

* cited by examiner

*Primary Examiner*—Jack W. Lavinder
(74) *Attorney, Agent, or Firm*—Alston & Bird LLP

(57) ABSTRACT

A zipper pull with a cover member, which has a simple structure and can be manufactured at a low cost, can realize a good and stable receiving and holding ability of a pull-tab over a long period of time, and also can prevent swinging between respective component parts, is provided.

The cover member of the zipper pull is made of a soft material and has a shape so as to prevent the condition that the pull-tab substantially and directly contacts adjoining portions of an article in the immovable state at the first position. When a slider body and the pull-tub are received in a receptacle, at least the cover member and the slider body are supported and fixed with moving interruption means for interrupting a relative movement of the cover member and the slider body.

15 Claims, 14 Drawing Sheets

ZIPPER PULL WITH COVER MEMBER

BACKGROUND OF THE INVENTION

1. Field of the Invention

The present invention relates to a zipper pull, and particularly relates to a zipper pull with a cover member capable of realizing stable and good receiving and holding property of a zipper pull-tub for a long period of time and further, capable of preventing backlash among respective component parts with each other.

2. Description of the Related Art

Conventionally, for example, zippers are widely used as fasteners for articles, such as bags and rucksacks, and for clothing articles, such as jackets, sweat suits, etc. As one example of the zippers, there is a common zipper pull attached to an opening of the aforementioned articles, which comprises a slider body selectively engaging and disengaging opposed engaging elements of a pair of co-operating zipper stringers by operation of a zipper pull, and a pull-tab that is made of a rigid material and is movably connected to the slider.

In addition, as the other example of the zippers, there is a zipper pull, which comprises three members including the slider body, the pull-tab and a cover member. This cover member is connected to the pull-tab and is adapted to be movable between a first position in which the pull-tab is concealed and a second position in which the pull-tab is revealed. This zipper provided with the cover member is often used as fasteners of clothes used by motorcyclists. The clothes can be made of leather, imitation leather, or similar materials, and which in general are rather costly. In such clothes, a prolonged and frequent bouncing of the pull-tab in use may, besides being annoying the rider, causes wear and damage of the portions of the clothes adjoining the zipper pull because the zipper pull directly contacts the adjoining portions of the clothes, and thereby representing inconvenience.

An example of a zipper provided with such kind of cover member is disclosed in, for example, U.S. Pat. No. 1,988,761. In the zipper pull disclosed in the U.S. Pat. No. 1,988,761, a flat, rigid cover plate is hingedly connected to the pull-tab. The cover plate is resiliently biased at the first position (a rest position), in which an unornamental assembly comprising the slider body and the pull-tab is concealed, in a direction contacting the adjoining portions of the article. Consequently, more neat and ornamental articles can be obtained.

On the other hand, as the other example of this zipper pull, for example, the specification of U.S. Pat. No. 5,101,538 discloses the other zipper pull having a pull-tab. A portion of a ring is integrally fixed to a free end of the pull-tab disclosed in this specification so as to surround this pull-tab, at the same time of molding the ring. This ring is always biased to an element side such that this ring is located on the same plane as the pull-tab. Therefore, when the ring is rotatably operated in a direction at which the ring is detached from the elements at a certain angle, its rebound resilience has been increased. This attaching position and the resilience of the ring acts for reducing the tendency of the zipper pull to bounce, which can be particularly annoying a person involved in a ritmic activity such as jogging. This resilient ring however leaves the pull-tab and the slider body of the zipper substantially unconcealed.

As described above, the zipper pull disclosed in the above mentioned U.S. Pat. No. 1,988,761 is biased to the first position in which the assembly is concealed in a direction contacting the adjoining portions of the article. Therefore, structurally, this zipper pull may be easily affected by the above mentioned defects and in this point, this zipper pull remains the same as before. Further, according to this conventional zipper pull, a connected portion shaped in a hinge between the rigid cover plate and the pull-tab is embossed upward and as well, the free end of the cover plate conceals the pull-tab with being abutting on a top surface of the slider body. Thus, for example, when this zipper pull is used as the fastener of the clothes used by the motorcyclist and the zipper pull bounces for a long time during use, the free end of the cover plate hits the top surface of the slider body hardly and this also involves a defect such that backlash among respective component parts may be generated as well as the hitting sound may annoy the motorcyclist.

In addition, the zipper pull disclosed in the above mentioned U.S. Pat. No. 5,101,538, as described above, has a function to reduce the tendency of the zipper pull to bounce by the attaching position of the ring for fixing the free end of the pull-tab and the resilience of the ring, however, the ring does not conceal the pull-tab and the slider body of the zipper. Therefore, not only the slider body of the zipper but also the structure around the connected portion with this pull are revealed to the outside, so that the article looks unattractive. In addition, according to this conventional zipper pull, the ring contacts the engaging elements more than the art disclosed in the above mentioned U.S. Pat. No. 1,988,761, so that the ring resiliently abut on a row of the engaging elements upon each turning the pull-tab via this ring. In this case, the ring may hit the adjoining portion of the clothes or the other articles and it is possible that the ring may damage the elements and their adjoining portion.

SUMMARY OF THE INVENTION

An object of the present invention is to provide a zipper pull with a cover member capable of being structured simply and with a low cost and realizing stable and good receiving and holding property of a zipper pull-tub for a long period of time and further, capable of preventing backlash among respective component parts with each other.

According to the invention, a zipper pull attached to an opening of the aforementioned articles, which comprises a slider body selectively engaging and disengaging opposed engaging elements of a pair of co-operating zipper stringers by operation of a zipper pull, being characterized in that the zipper pull further comprises a pull-tab made of rigid material and movably connected to the slider body, and a cover member connected to the pull-tab and made movable between a first position in which the pull-tub is concealed in the immovable state and a second position in which the pull-tab is revealed, and the cover member is made of a soft material and has a shape so as to prevent the condition that the pull-tab substantially and directly contacts the adjoining portions of the article at the first position.

Similarly to the aforementioned U.S. Pat. No. 1,988,761, the zipper pull according to the invention also comprises three members, namely, the slider, the pull-tab, and the cover member and the pull-tab is concealed within the cover member at least at the first position in which the pull-tab is concealed. However, the zipper pull according to the invention is greatly different from the conventional pull-tab in that the zipper pull according to the invention has a shape such that the pull-tab is maintained in the immovable state at the first position to prevent any direct contact of the pull-tab with the adjoining portions of the article.

As described above, according to the conventional arts disclosed in the aforementioned U.S. Pat. No. 1,988,761 and U.S. Pat. No. 5,101,538, the zipper pull tends to directly contact the row of the engaging elements and the adjoining portions of the clothes, and it causes wear or damage of the portions of the clothes adjoining the zipper pull. According to the invention, the cover member is made of a soft material and has a shape so as to prevent the condition that the pull-tab directly contacts the adjoining portions of the article at the first position. With this structure, the cover member is made immovable at the first position at which the pull-tab is concealed, and it makes possible for the pull-tab and the cover member itself to have a holding power against the pull-tab to prevent the movement of the pull-tab to the position contacting the adjoining portion of the article.

In addition, according to the invention, since the cover member is made of a soft material such as a soft synthetic resin, rubber, leather, or the like, the appearance thereof is soft and when the pull-tab is concealed at the first position, this cover member is well fitted with the outer shape of the pull-tub and further, even when the zipper pull contacts the other peripheral members, a harsh noise of a metallic clank is not generated.

Preferably, a receptacle for receiving and holding at least the pull-tab is formed on an inner side surface of the cover member.

Within the receptacle of the cover member, a sufficient space is secured, in which at least the pull-tab can be received and held. At the first position, at least the pull-tab can be completely concealed as well as the pull-tab is received and held immovably in the receptacle of the cover member. In addition, the zipper pull according to the invention has an elaborately designed appearance, so that a more neat and ornamental zipper pull having a higher commercial value can be effectively obtained.

Preferably, the receptacle of the cover member has an entrance passage having a size smaller than a corresponding dimension of the pull-tab and the pull-tab is firmly fitted in the receptacle through the entrance passage.

This invention defines a typical structure of the receptacle of the cover member. Since the cover member is made of the soft material, the cover material is firmly fitted and is supported along the outer shape of the pull-tab within the receptacle at the first position and it is easily transformed from the first position toward the second position, so that the pull-tab is detached from the receptacle to the outside. Therefore, it is possible to firmly hold the pull-tab within the receptacle of the cover member, and further, it is possible to easily and smoothly engage and disengage the pull-tab from the receptacle of the cover member.

Preferably, according to the invention, a receptacle for receiving and holding at least a part of right and left side surfaces of a slider body is formed on the inner side surface of the cover member.

This invention defines the other typical structure of the receptacle of the cover member and a sufficient space is secured, in which the side surfaces of the slider body is partially received in the inner side surface of the cover member. At the first position, the pull-tab is received in the receptacle and at the same time, a portion of the slider body can be fitted and supported. Further, by utilizing the soft material of the cover member, from the first position toward the second position, the pull-tab and the slider body are made easily detached from the receptacle. In the other words, according to the above described structure, it is possible to simply and smoothly engage and disengage a portion of the slider body together with the pull-tab in the receptacle of the cover member.

Next, the typical structure of the cover member is defined. According to the invention, an outer side surface in a longitudinal direction of the cover member has a convex curved surface. Alternately, the cover member is essentially shell-shaped, and its inner side surface is a concave curved surface facing the pull-tab. Preferably, the cover member has an essentially C-shaped transverse cross section.

Preferably, the cover member has an end portion which at the first position axially protrudes with respect to the pull-tab and the slider body and is manually grasped by a user to displace the cover member from the first position. It is preferable that the end portion of the cover member is longitudinally tapered. Alternately, it is defined that the end portion of the cover member has a tapered side surface.

In addition, a preferable material of the above described cover member may be defined and the cover member is made of soft plastics or rubber material.

Preferably, the pull-tab has a first end portion that is connected to the slider body, the cover member has an upper wall portion and right and left side wall portions and is connected to a second end portion of the pull-tab, which is at an opposite side of the first end portion, and moving interruption means is provided to prevent a relative movement of the slider body and the cover member at a first position of the cover member.

At the first position, the cover member and the slider body are engaged by the moving interruption means, and the slider body and the cover member are maintained in the immovable state. Since the zipper pull is provided with the moving interruption means, the cover member and the slider body do not move in any directions, so that it is possible to enhance a holding power with respect to the slider body.

Preferably, the moving interruption means is provided at a part of the receptacle of the cover member.

With the above structure, the portion of the receptacle of the cover member can be effectively used as the moving interruption means, and when the part of the slider body is received in the receptacle of the cover member, the cover member and the slider body are capable of being supported and fixed firmly and securely with the moving interruption means. In addition, the cover member is not deviated through the slider body and at the same time, the pull-tab is firmly fixed, so that it is possible to prevent the movement of the cover member and the pull-tab in any directions. Accordingly, it is possible to secure a quality of a zipper and the article, in which the zipper is attached, over a long period of time.

Preferably, the slider body has a pull attaching post on a part of an upper surface of the slider body, and the pull attaching post is fitted and supported in the receptacle by the moving interruption means.

Upon mounting the upper wall portion and the right and left side wall portions of the cover member on the pull attaching post that is fixed on the upper surface of the slider body, the positioning of the cover member in the longitudinal and the width direction is carried out, and the cover member is firmly fixed to the pull attaching post through the moving interruption means, so that it is possible to attach the cover member accurately and smoothly without revealing the fixing structure or the like to the outside, the fixing structure being provided to the cover member and the slider body.

It is preferable that, on an inner surface of the upper wall portion of the cover member, a fitting concave portion is provided to be engaged with an upper end portion of the pull attaching post. Accordingly, the cover member may have a simple structure as described above, so that a complex structure becomes unnecessary, the zipper pull can be compact and thinner, and further, the zipper pull can be easily treated.

Preferably, the moving interruption means is provided at a part of the right and left end portions of the upper plate of the slider body and the receptacle is provided at a part between opposed surfaces of the right and left side wall portions of the cover member, and by the moving interruption means, the receptacle is fitted and supported in the part of the right and left end portions of the upper plate.

When the slider body is received within the receptacle of the cover member, the right and left side wall portions of the cover member are simultaneously fitted into the right and left end portions of the upper plate of the slider body easily through the moving interruption means, so that the cover member may be supported and fixed firmly and securely. As a result, even in the simple structure such that the right and left side wall portions of the cover member and the right and left end portions of the slider body are fitted and fixed, upon fitting and fixing them, the both of them can be firmly and detachably fixed, and this results in remarkable improvement of assemble ability, a reliability, and the like.

Preferably, the moving interruption means are formed on the opposed surfaces of the right and left side wall portions of the cover member and the right and left end surfaces of the slider body, respectively, and the moving interruption means has a projecting portion or a concave portion to be fitted with each other.

In this case, for example, the movement interruption means can be configured by projecting row portions or projecting portions that are formed on any one of the opposed surfaces of the right and left side wall portions of the cover member and the right and left end surfaces of the slider body, and the concave portions that are formed on the other one of the opposed surfaces of the right and left side wall portions of the cover member and the right and left end surfaces of the slider body. As a result, it becomes possible to secure a contact area of the cover member and the slider body, and by setting the projecting portions and the concave portions as the right and left movement interruption means accordingly, the firm holding power between the respective component parts can be obtained.

In addition, the typical structure of the cover member may be defined. In other words, it is preferable that the cover member is hingedly connected to the pull-tab. In addition, it is preferable that the pull-tab has a first end connected to the slider body, and the cover member is connected to a second end of the pull-tab which is opposite to the first end, whereby at the second position the cover member forms an extended portion of the pull-tab adapted to be grasped by a user.

Since the extended portion of the cover member is extended at the above described first position in an axial direction with respect to the pull-tab and the slider body, the user can easily move the cover member from the first potion toward the second position by grasping the extended portion with his or her fingers, so that the user can attach and detach the cover member easily. In addition, since, at the first position, the cover member and the slider body are partially received and held in the receptacle of the cover member in an immovable state and further, the pull-tab and the slider body are concealed, the attaching and detaching operativity of the cover member can be improved even with a simple structure, and it is possible to effectively obtain a zipper pull having an elaborately designed appearance and a higher commercial value.

DESCRIPTION OF THE PREFERRED EMBODIMENTS

The preferable embodiments according to the invention will be specifically described with reference to the attached drawings below.

Figure 1:
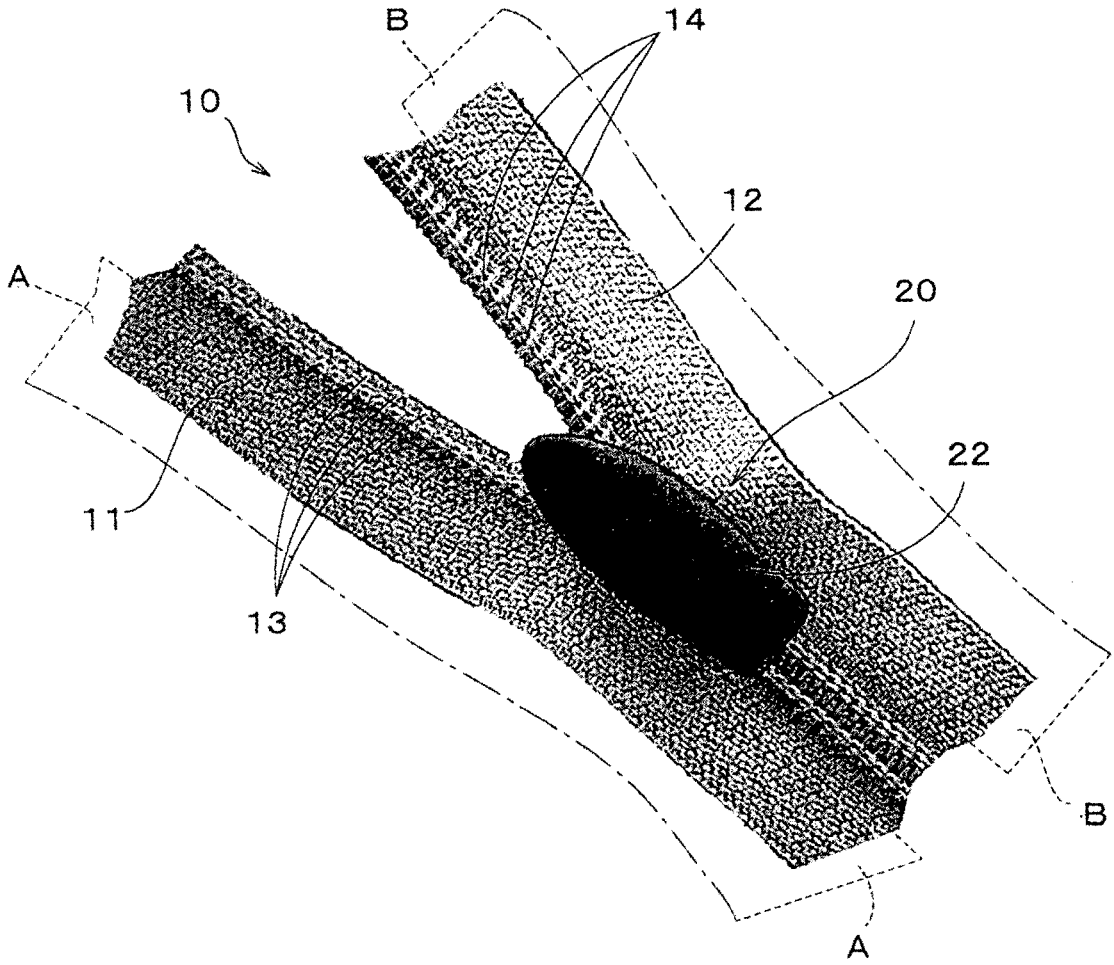
FIG. 1 is a perspective view of a zipper or a slide fastener comprising a zipper pull according to the invention in a first position.

FIGS. 1 to 9 show a first embodiment of a typical zipper pull according to the invention. In FIG. 1, there is shown a slide fastener or zipper 10 comprising, in a per se known manner, two stringers 11 and 12, which can be for instance woven strips. The stringers 11 and 12 are provided respectively with a series of engaging elements 13 and 14, such as teeth.

The zipper 10 is intended primarily for being used in clothes, particularly for motorcyclists, although other use is possible. The stringers 11 and 12 of zipper 10 are securely attached to each portions of the article respectively, in a per se known manner to respective portions or the article, the portions being shown in phantom line and indicated by reference numerals A and B in FIG. 1. The zipper 10 includes a slider body, indicated by a reference numeral 15 in FIGS. 2 to 8. The slider body 15 is adapted to selectively engage and disengage the engaging elements 13 and 14 of the stringers 11 and 12.

Figure 2:
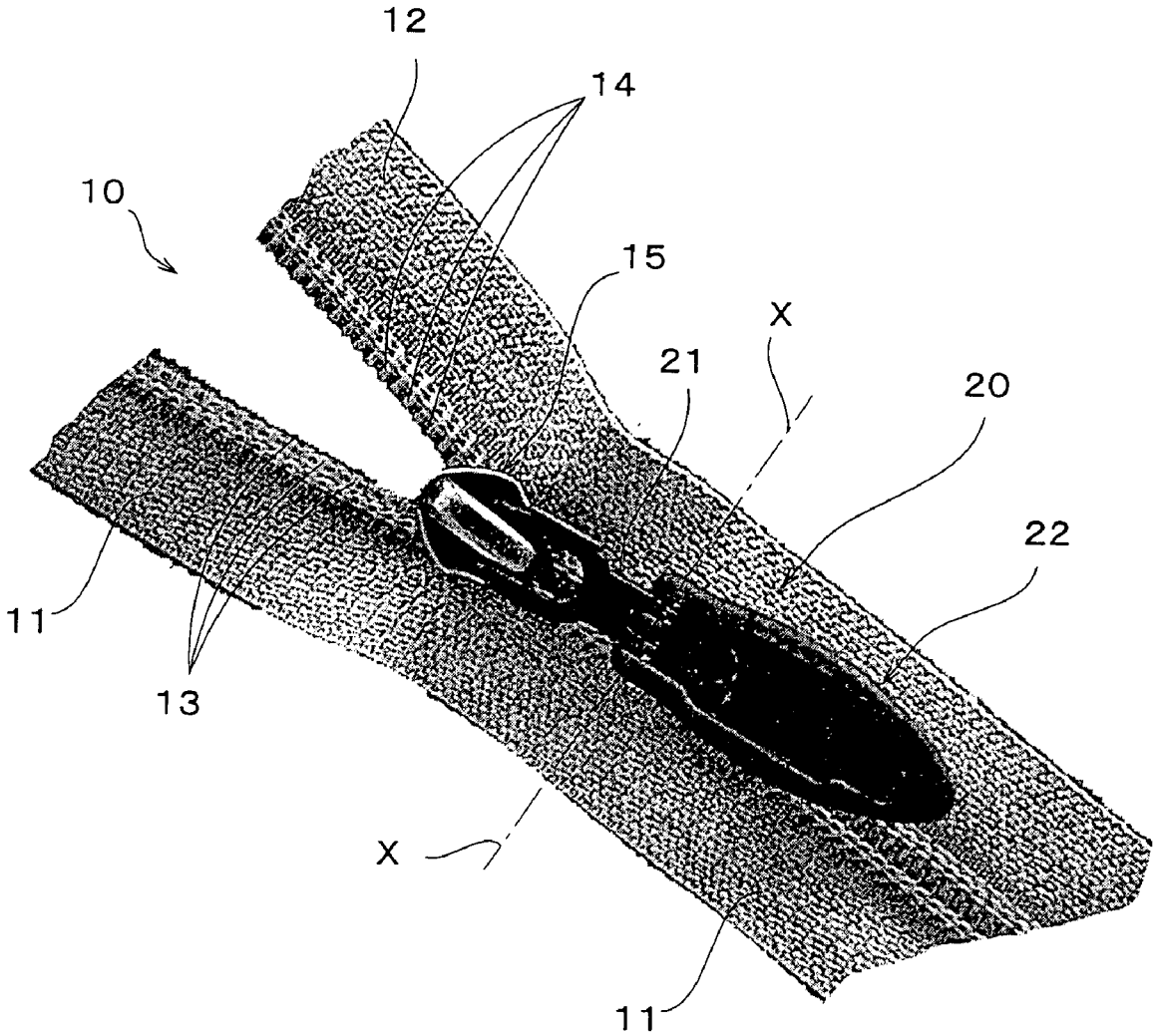
FIG. 2 is a perspective view of a zipper or a slide fastener comprising a zipper pull according to the invention in a second position.
Figure 3:
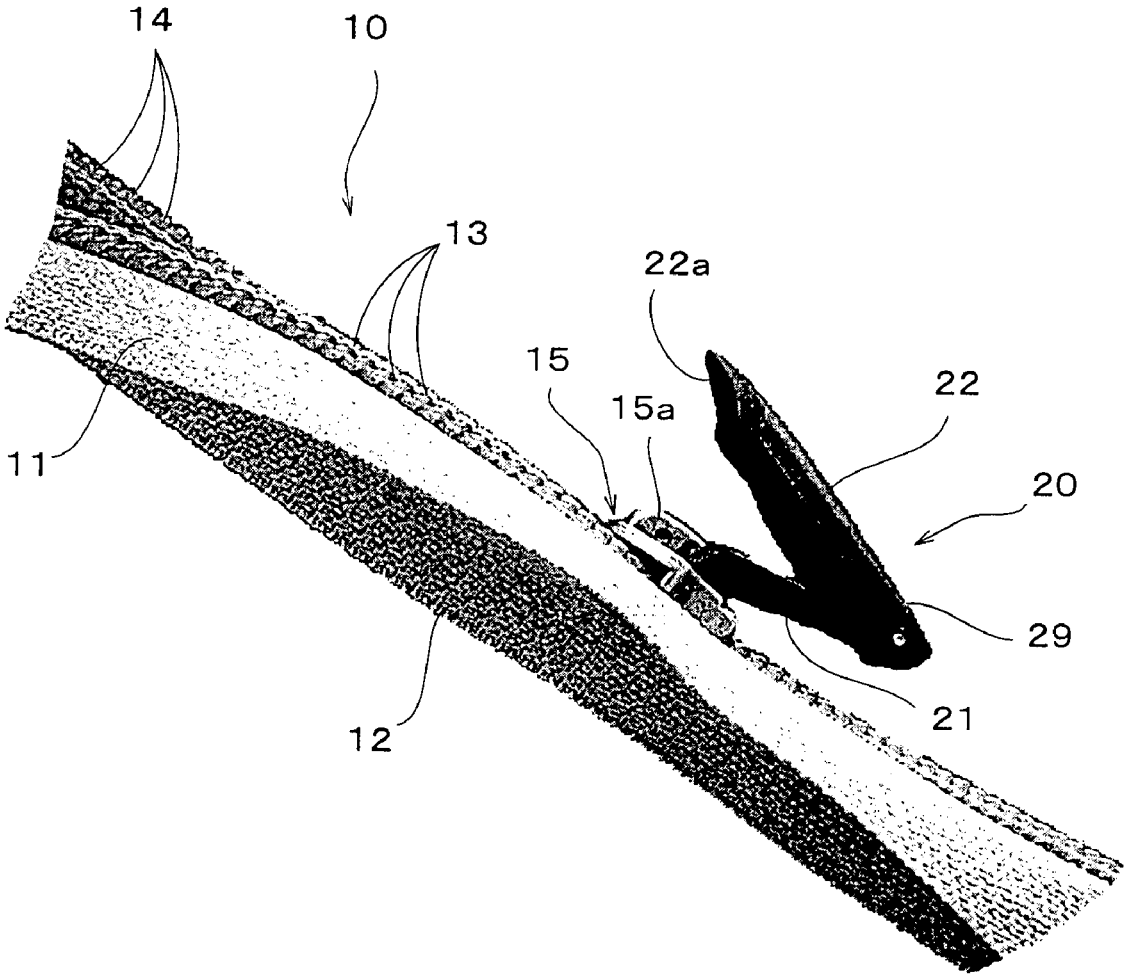
FIG. 3 is a side view of the zipper shown in FIGS. 1 and 2, with the zipper pull shown in an intermediate position.
Figure 4:
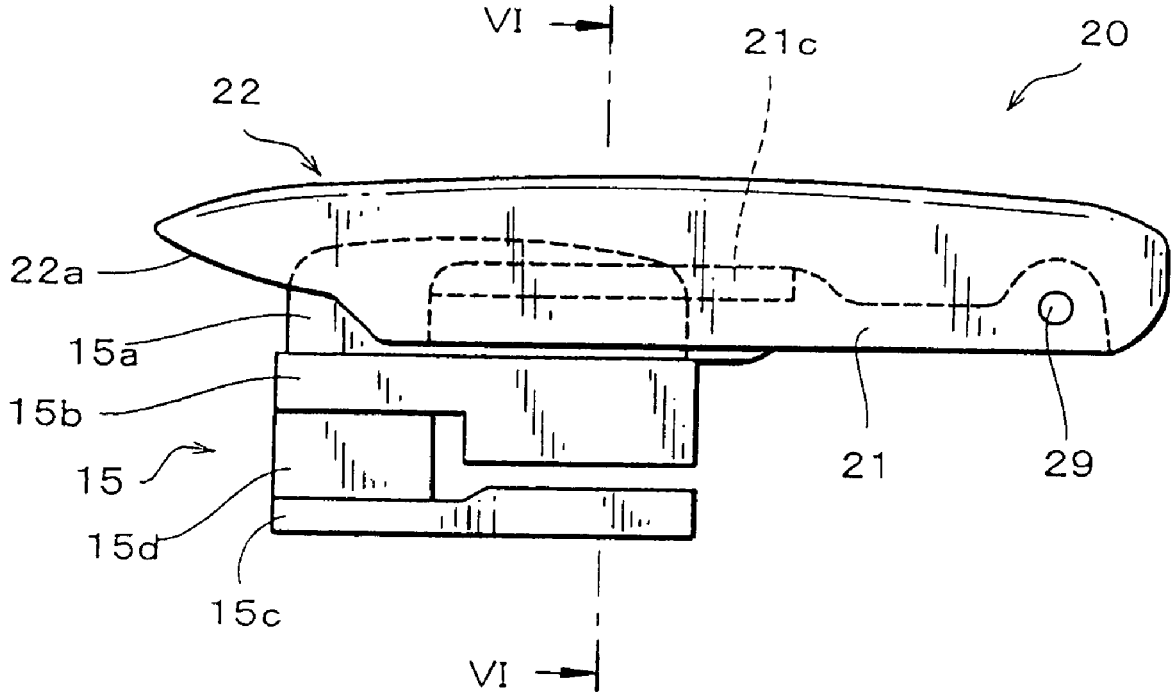
FIG. 4 is a side view of an assembly comprising a slider body and a zipper pull according to the invention.

A zipper pull, indicated by a reference numeral 20 as a whole, is connected to the slider body 15 and comprises an essentially rigid pull-tab 21 and a cover member 22 hingedly connected to the pull-tab 21 about an axis indicated by a reference mark X-X in FIG. 2. In the non-limited typical embodiment shown in the drawings (see in particular FIGS. 8 and 9), the pull-tab 21 has an essentially ring-shaped first end portion 21*a*, which is hooked to a corresponding upstanding structure (a pull attaching post) 15*a* of the slider body 15 (FIG. 8), so as to be oscillatable with respect to the slider body 15.

The pull-tab 21 has a second, essentially fork-shaped end portion 21*b* (see FIGS. 8 and 9), which is hingedly connected to one end of the cover member 22. The cover member 22 is made of, for example, a soft material, such as a plastic or rubber material.

Figure 8:
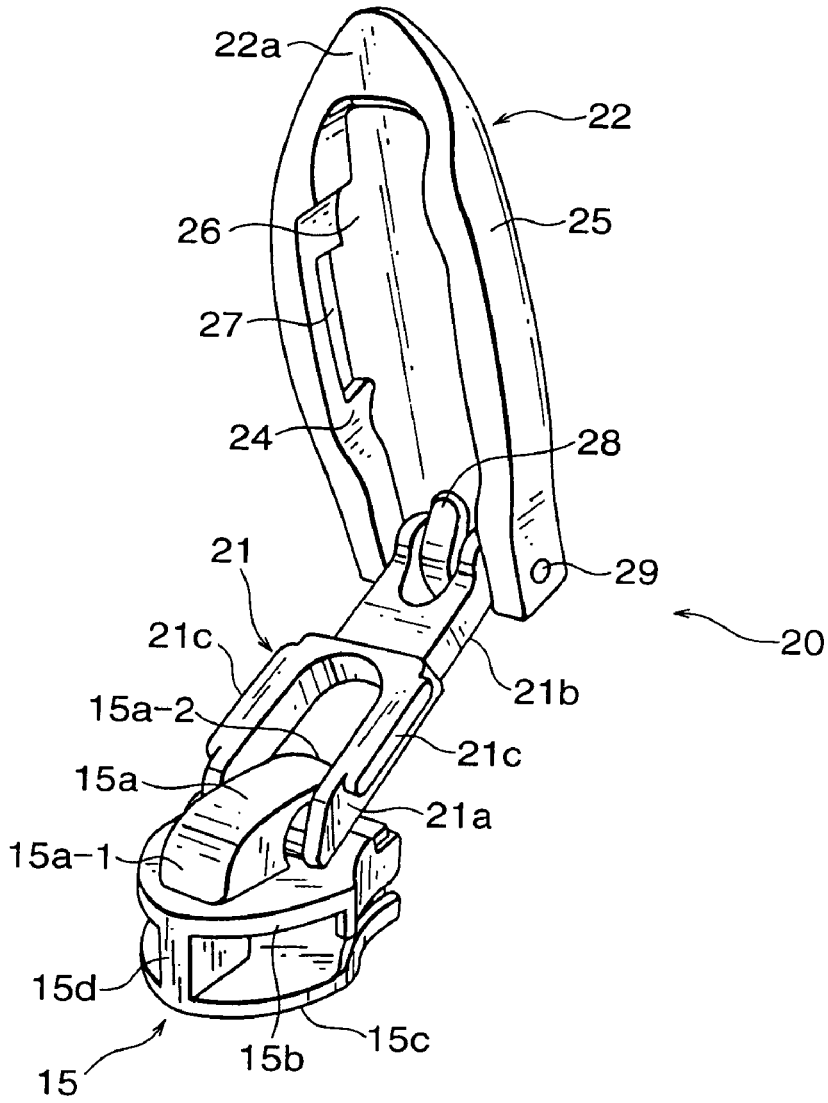
FIG. 8 is a perspective view of the assembly shown in FIGS. 4 to 7.
Figure 9:
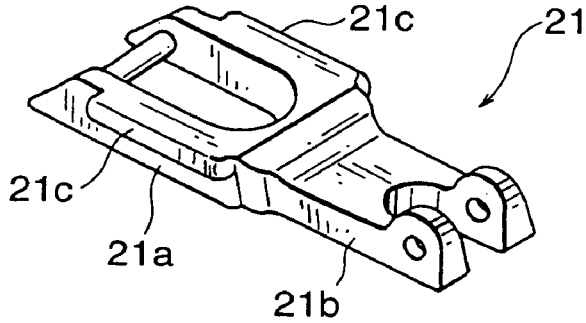
FIG. 9 is a perspective view of a pull-tab comprised in a zipper pull according to the invention.

In the typical embodiment shown in the drawings, the cover member 22 is essentially shell-shaped, and have a concave inner side surface 24, and a convex outer side surface 25 (FIG. 8). In the concave inner side surface 24 of the cover member 22, a receptacle 26, essentially in the form of an elongated groove, is formed, and the pull-tab 21 is received and held in the receptacle. On the opposite side surfaces of a first end portion 21*a* of this pull-tab 21, outwardly extending projecting raw portions or winglets 21*c* are formed respectively (see in particular FIGS. 8 and 9).

The inner surfaces of the longitudinal opposite side wall portions which delimit the receptacle or groove 26 of the cover member 22 are respectively provided with recesses 27 (see FIG. 8, wherein only one of the recesses 27 is visible), the recess being adapted to receive one of the projecting row portions 21*c* of the pull-tab 21. In the region of the recesses 27, the transverse width of the receptacle 26 of the cover member 22 is larger than the overall transverse width of the first end portion 21*a* of the pull-tab 21. Thus, the first end 21*a* is to be forced-fitted into the receptacle 26 in order to engage the projecting row portions 21*c* into the corresponding recesses 27 of the cover member 22.

Figure 5:
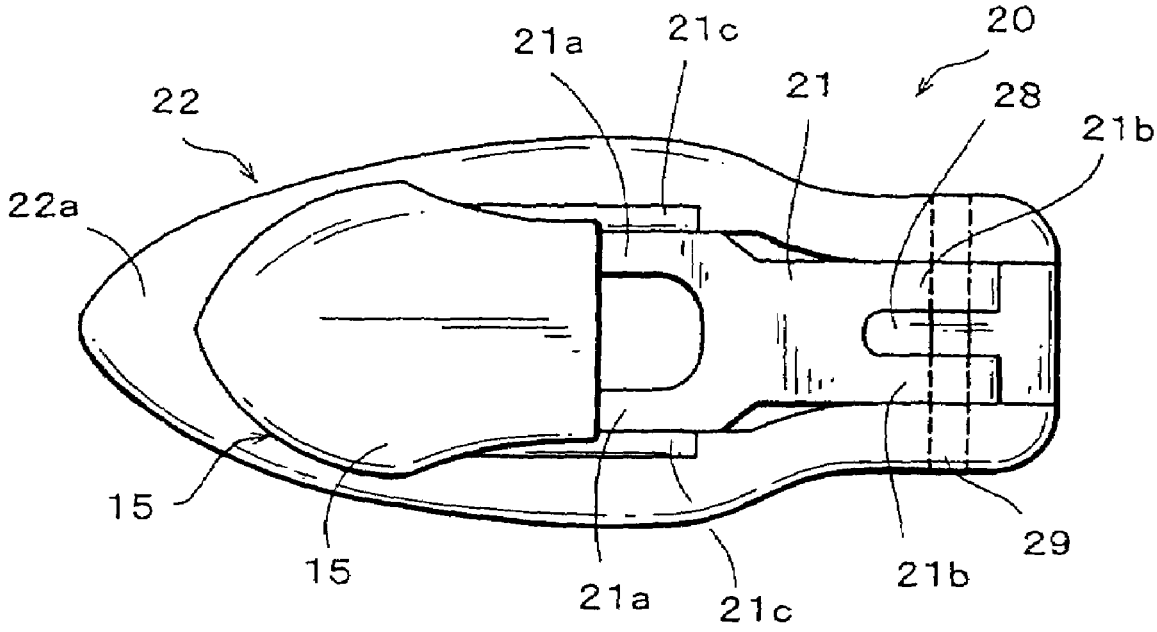
FIG. 5 is a bottom plan view of the assembly shown in FIG. 4.

The fork-shaped end portion 21*b* of the pull-tab 21 has two arms, which are engaged between the opposite side wall portions of the receptacle or groove 26 and a central projection 28 of the cover member 22 (FIGS. 5 and 8). The hinge connection between the pull-tab 21 and the cover member 22 is achieved through a pin 29 fitted and fixed through the projection 28 and the opposite side wall portions of the cover member 22, as well as through the respective arms of the fork-shaped second end portion 21*b* of the pull-tab 21.

Figure 6:
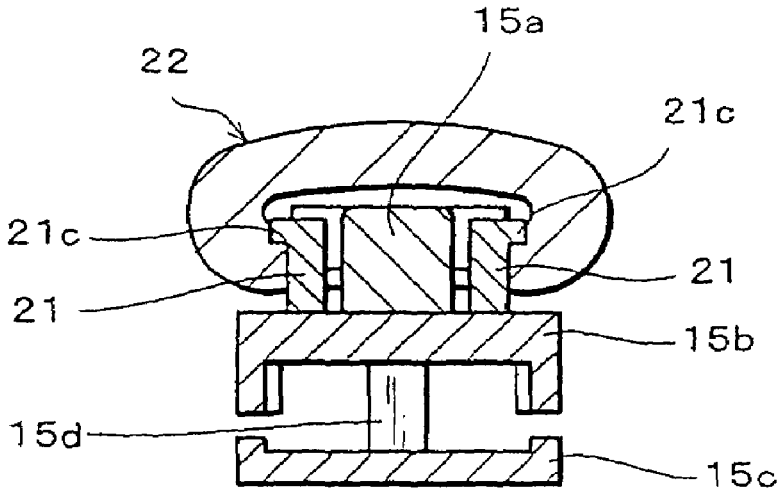
FIG. 6 is a sectional view on arrow taken along the line VI-VI in FIG. 4.
Figure 7:
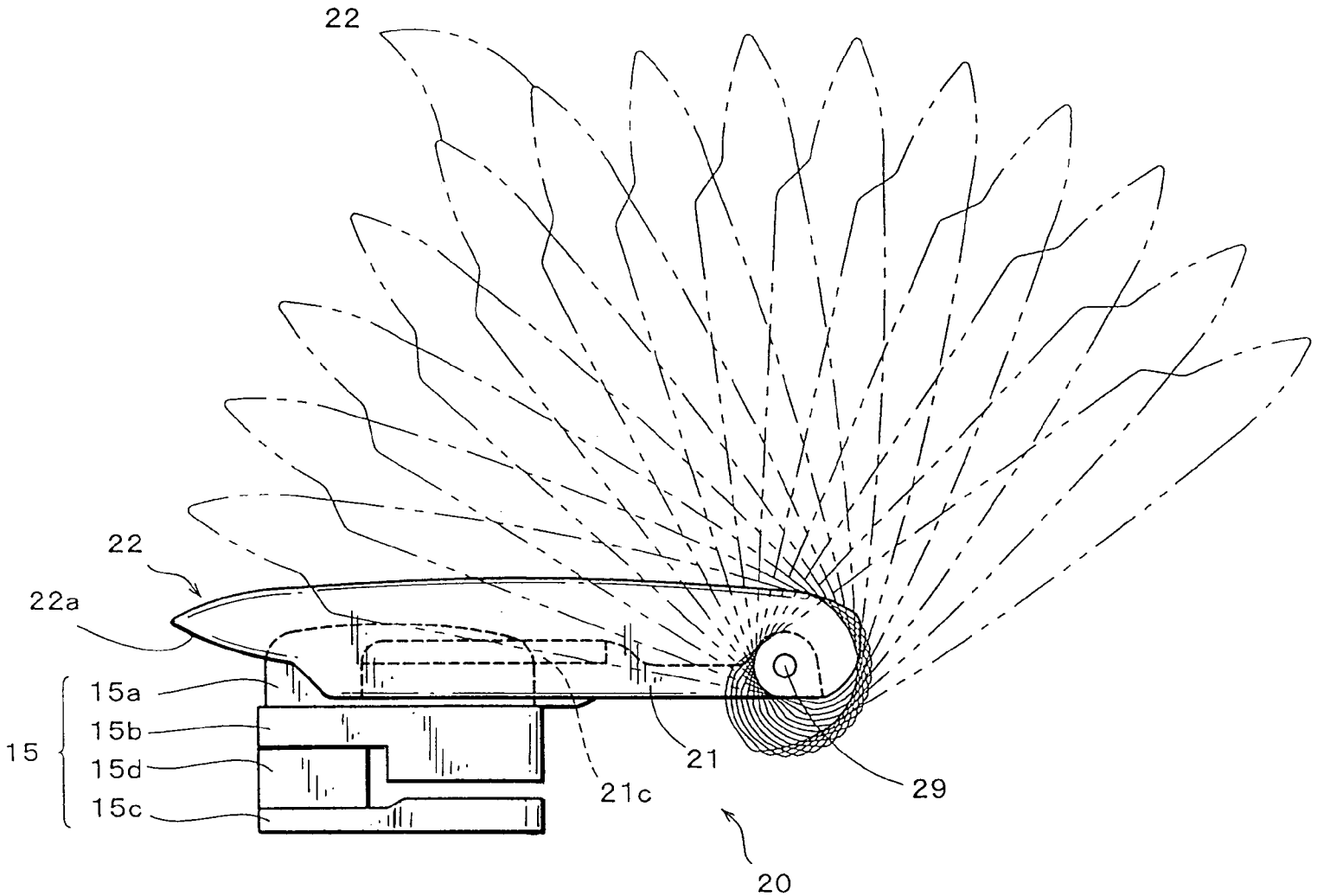
FIG. 7 is a side view of the assembly of FIGS. 4 to 6, showing the zipper pull in a variety of positions.

As is obvious in FIG. 6, in the region of the recesses 27, the cover member 22 has an essentially C-shaped cross-section. The cover member 22 is made movable between a first position shown in FIG. 1 and FIGS. 4 to 6, in which it conceals the pull-tab 21, and a second position, shown in FIG. 2, in which it reveals the pull-tab 21.

The shape of the cover member 22 is not particularly limited but it is a common and simple structure, and at the first position, it is adapted to prevent any direct contact of the pull-tab 21 and the slider body 15 with the adjoining portions A and B of the article to which the zipper pull-tab 10 is attached. Thus, the initially described deficiency of the zipper pull of the related art, that a high frequency bouncing of the pull-tab 21 at the first position causes partially wear and damage of the article, is overcome.

Preferably, as is obvious in FIGS. 3, 4, 7 and 8, the cover member 22 has a free end portion (an extended portion) 22*a* which at the first position (FIG. 4) protrudes axially with respect to the pull-tab 21 and the slider body 15, and is adapted to be grasped by a user with his or her fingers to displace the cover member 22 from the first position. The free end portion 22*a* of the cover member 22 is preferably tapered longitudinally, and more preferably, has a tapered side surface.

Since the cover member 22 that has been configured as described above is made of a soft material and it is easily transformed from the first position toward the second position, the cover material 22 is firmly fitted and is supported along the outer shape of the pull-tab 21 within the receptacle 26 at the first position, and the pull-tab 21 is detached from the receptacle 26 at the second position. Thus, it is possible to firmly receive and securely hold the pull-tab 21 within the receptacle 26 of the cover member 22, and further, it is possible to easily and smoothly engage and disengage the pull-tab 21.

In addition, the cover member 22 is structured to have a shape such that at the first position, it prevents any direct contact of the pull-tab 21 with the adjoining portions A and B of the article. According to this structure, the cover member 22 is made immovable at the first position, the movement of the pull-tab 21 and the cover member 22 to the position wherein they contact the adjoining portion A and B of the article is restrained, and it makes possible for the pull-tab 21 and the cover member 22 to have a holding power against the pull-tab 21.

In addition, according to the invention, the cover member 22 is made of a soft material and the cover member 22 has a shape such that at the first position, it prevents any direct contact of the pull-tab 21 with the adjoining portions A and B of the article. Thus, as the other characteristic features of the invention, a portion of the slider body 15 can be simply and smoothly engaged and disengaged in the receptacle 26 of the cover member 22 together with the pull-tab 21, and the holding power against the slider body 15 is secured with which the pull-tab 21 and the cover member 22 is made immovable in any directions at the first position.

Figure 10:
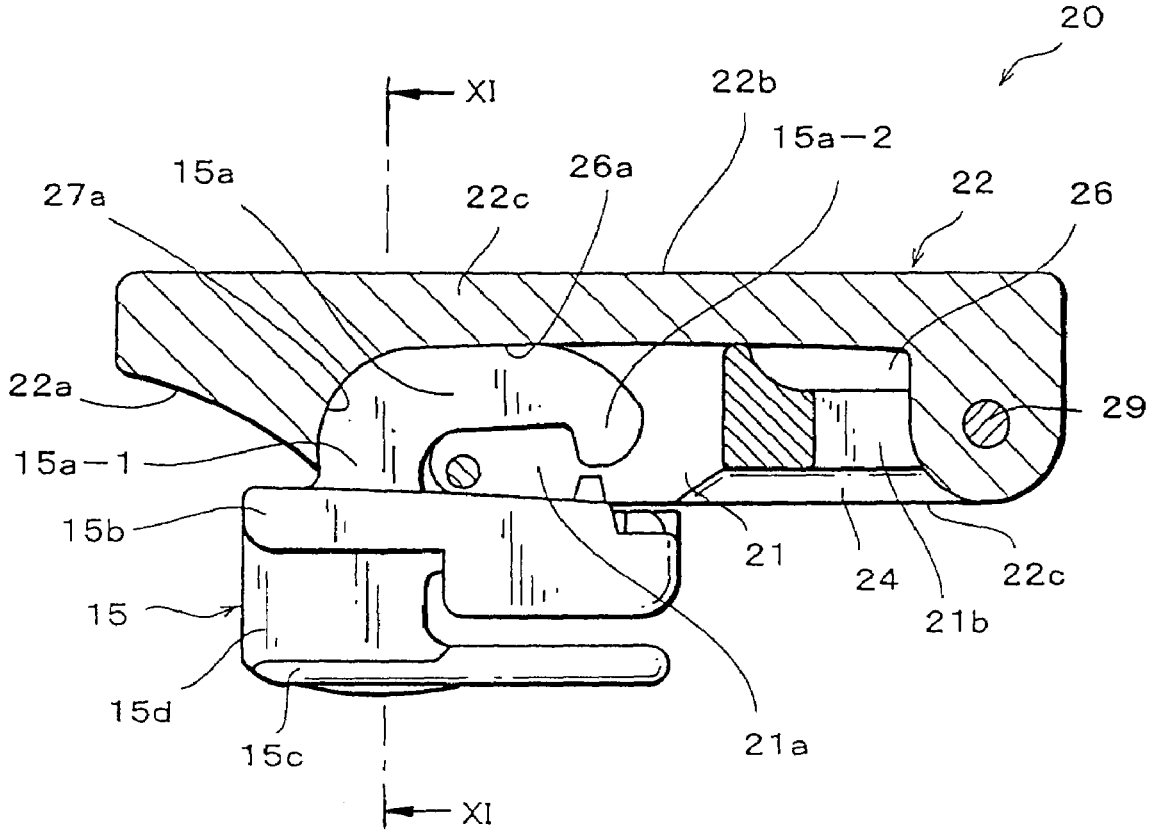
FIG. 10 is a main part longitudinal sectional view notching a portion of the assembly according to a second embodiment of the invention.
Figure 11:
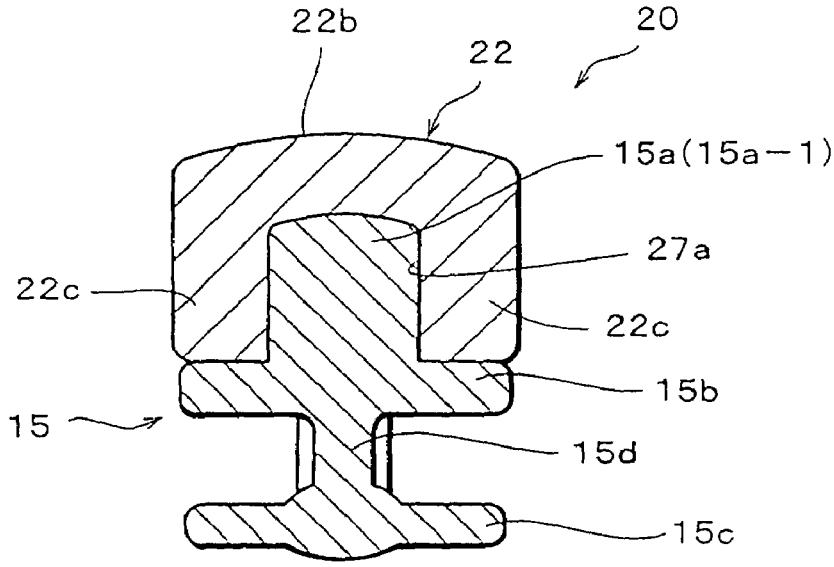
FIG. 11 is a sectional view on arrow taken along the line XI-XI in FIG. 10.

FIGS. 10 and 11 show a second embodiment of a zipper pull according to the invention. The second embodiment is greatly different from the above described first embodiment in that moving interruption means for interrupting the relative movement of the cover member 22 and the slider body 15 is provided at a part of the receptacle 26 of the cover member 22. Namely, at the inner side surface 24 of the cover member 22, the receptacle 26 for receiving and holding the right and left end surfaces of the pull-tab 21 and a receptacle 26*a* for receiving and holding at least part of the right and left side surfaces of the slider body 15 are formed. The pull-tab 21 and the cover member 22 has the same structure as the aforementioned embodiment in that the projecting row portions 21*c* and the recesses 27 are engaged and disengaged with each other. Accordingly, in these drawings, the members that are substantially identical with the above described first embodiment are provided with the same member names and the same reference marks or numerals.

According to these drawings, also in the second embodiment, the zipper pull comprises three members, namely, the slider body 15, the pull-tab 21, and the cover member 22 as shown in FIG. 10. The slider body 15 has upper and lower plates 15*b* and 15*c*, and a guiding pole 15*d* for coupling front portions of respective upper and lower plates 15*b* and 15*c*. From respective rear ends of the upper and lower plates 15*b* and 15*c* to the generally center positions thereof, right-and-left upper and lower flanges are provided, respectively. Between the upper and lower plates 15*b* and 15*c*, a Y-shaped guiding path for the engaging elements is formed. On the upper surface of this upper plate 15*b*, a pull attaching post 15*a* having post portions 15*a*-1 and 15*a*-2 at the back and forward end portions thereof, which has a C-shaped transverse cross-section.

The front end post portion 15*a*-1 is integrally molded on the upper surface of the front end portion of the upper wing 15*b* to stand, and a lower end of the rear end post portion 15*a*-2 is arranged in such a manner that it forms a space in which the ring-shaped first end portion 21*a* of the pull-tab 21 can be inserted and it is embossed from the upper surface of the upper plate 15*b*. Similarly to the slider body 15, the pull-tab 21 is not different from the above described first embodiment substantially.

On the other hand, as shown in FIG. 11, the cover member 22 has a generally C-shaped transverse cross-section having right and left side wall portions 22*c* that are formed at right and left of an upper wall portion 22*b* having a smooth convex curved surface on its upper side. On the inner surface of the upper wall portion 22*b*, at least rectangular fitting concave portion 27*a* is formed to be held at the upper end portion of the front end post portion 15*a*-1 of the pull attaching post 15*a*. The movement interruption means as one of main mechanisms of the zipper pull 20 according to this second embodiment comprises the pull attaching post 15*a* and the fitting concave portion 27*a*. This fitting concave portion 27*a* configures part of the receptacle 26*a* of the cover member 22. The receptacles 26 and 26*a* secure spaces capable of sufficiently receiving and holding at least the pull-tab 21 and the pull attaching post 15*a* respectively.

Upon fitting the cover member 22 with the slider body 15, the positioning in the back and forth direction and the width direction is carried out, and they are securely attached with each other without revealing a particular fixing structure at the outside of the cover member 22 and the slider body 15. When the cover member 22 and the slider body 15 are fitted with each other, the fitting concave portion 27*a* of the cover member 22 and the pull attaching post 15*a* are firmly fixed as well as the pull-tub 21 is engaged with the projecting row portions 21*c*, thereby preventing the movement of the cover member 22 in any directions.

Therefore, when the zipper pull 20 is positioned at the above described first position, even if a force to bound the cover member 22 with respect to the pull attaching post 15*a* acts directly on the cover member 22, the cover member 22 is not moved in the back and forth directions, the right and left directions, the oblique direction and the up-and-down direction, and it is possible to enhance the holding power of the cover member 22, so that a durability of the zipper pull can be enhanced. Accordingly, this cover member 22 can have a simple structure, so that a complex structure becomes unnecessary, and the zipper pull 10 is made to be more compact and thinner by appropriately setting the shape, size and the like of the fitting concave portion 27*a* of the cover member 22 depending on the shape and size and the like of the pull attaching post 15*a*.

In addition, as described above, since the raw material of the cover member 22 is a soft material such as a plastic, a rubber material or leather, it is natural that a soft touch in appearance can be well obtained, but further, even when the cover member 22 and respective component parts are crushed with each other, a harsh noise for the user is not generated, so that it is possible to prevent annoying the user.

Figure 12:
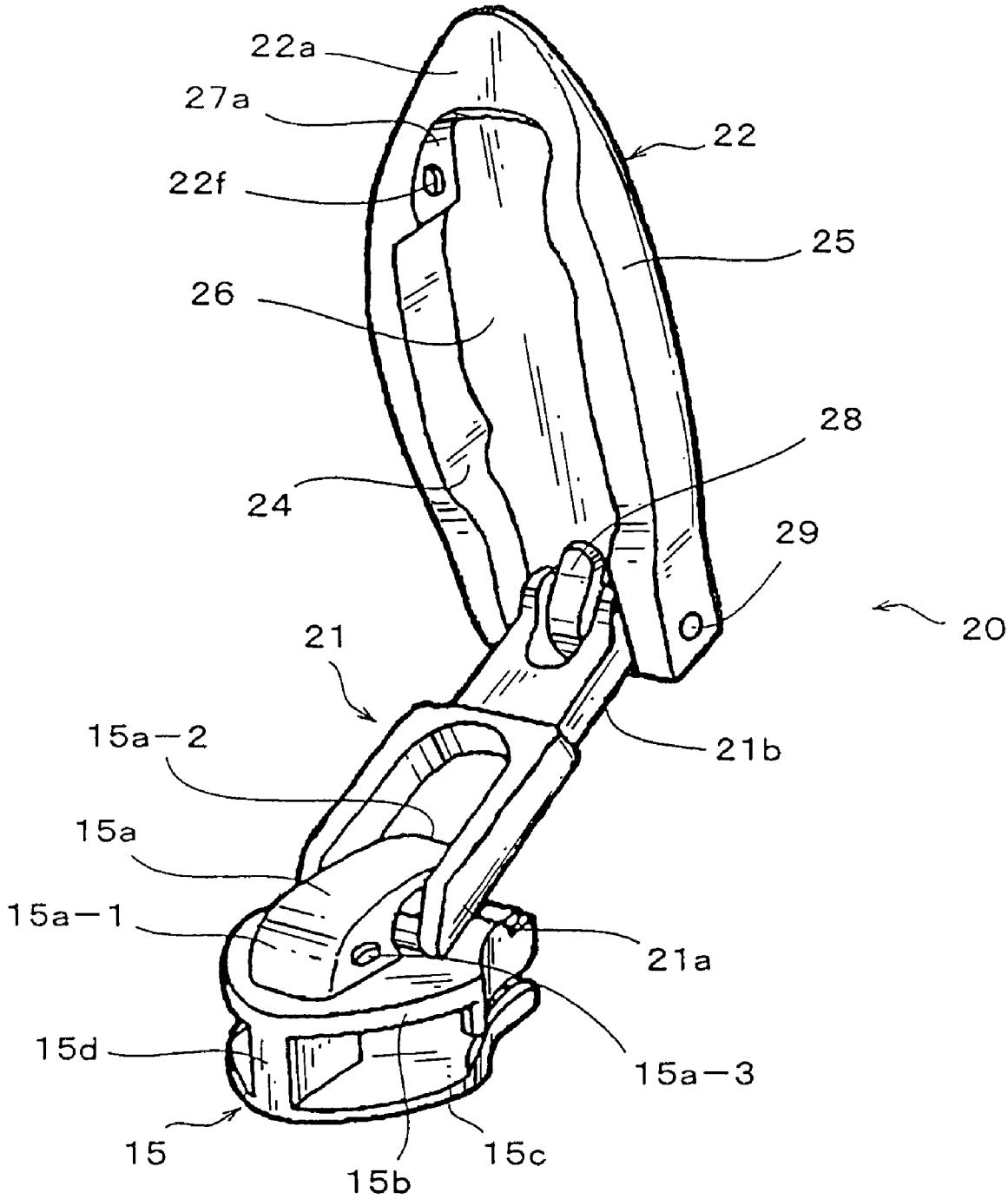
FIG. 12 is a perspective view of the assembly according to a third embodiment of the invention.
Figure 13:
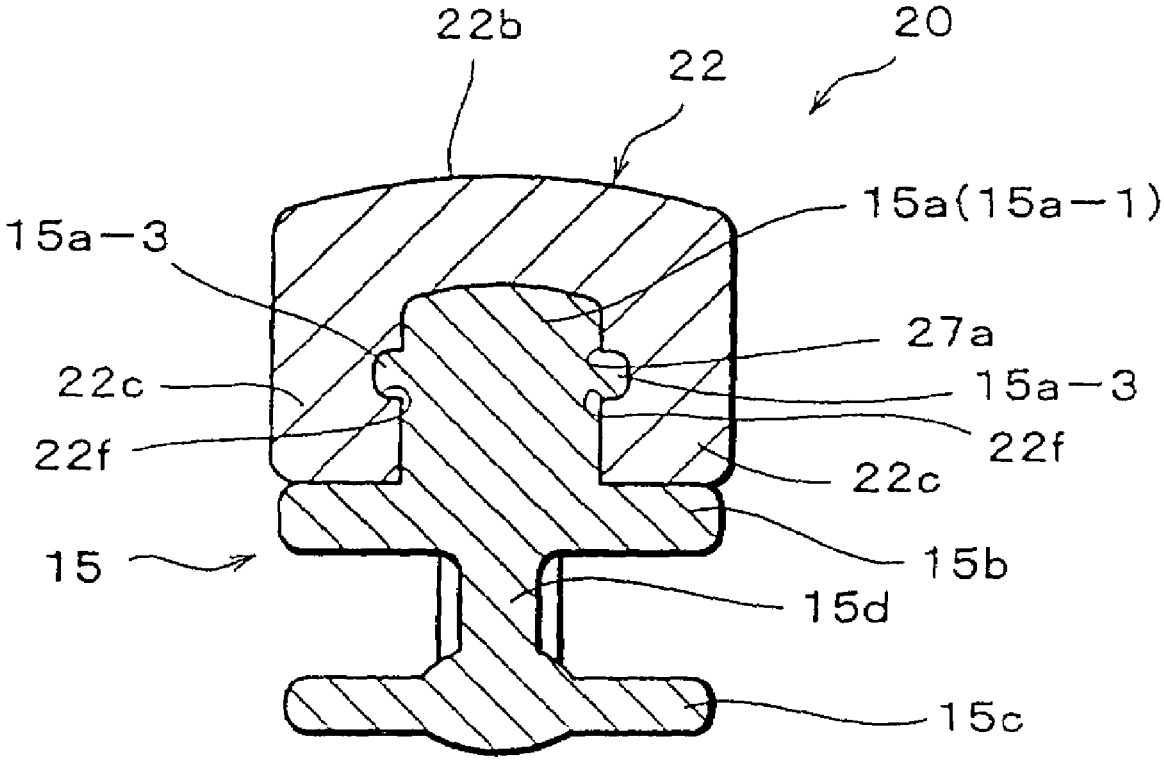
FIG. 13 is a sectional view of the assembly of the third embodiment, corresponding to FIG. 11.
Figure 14:
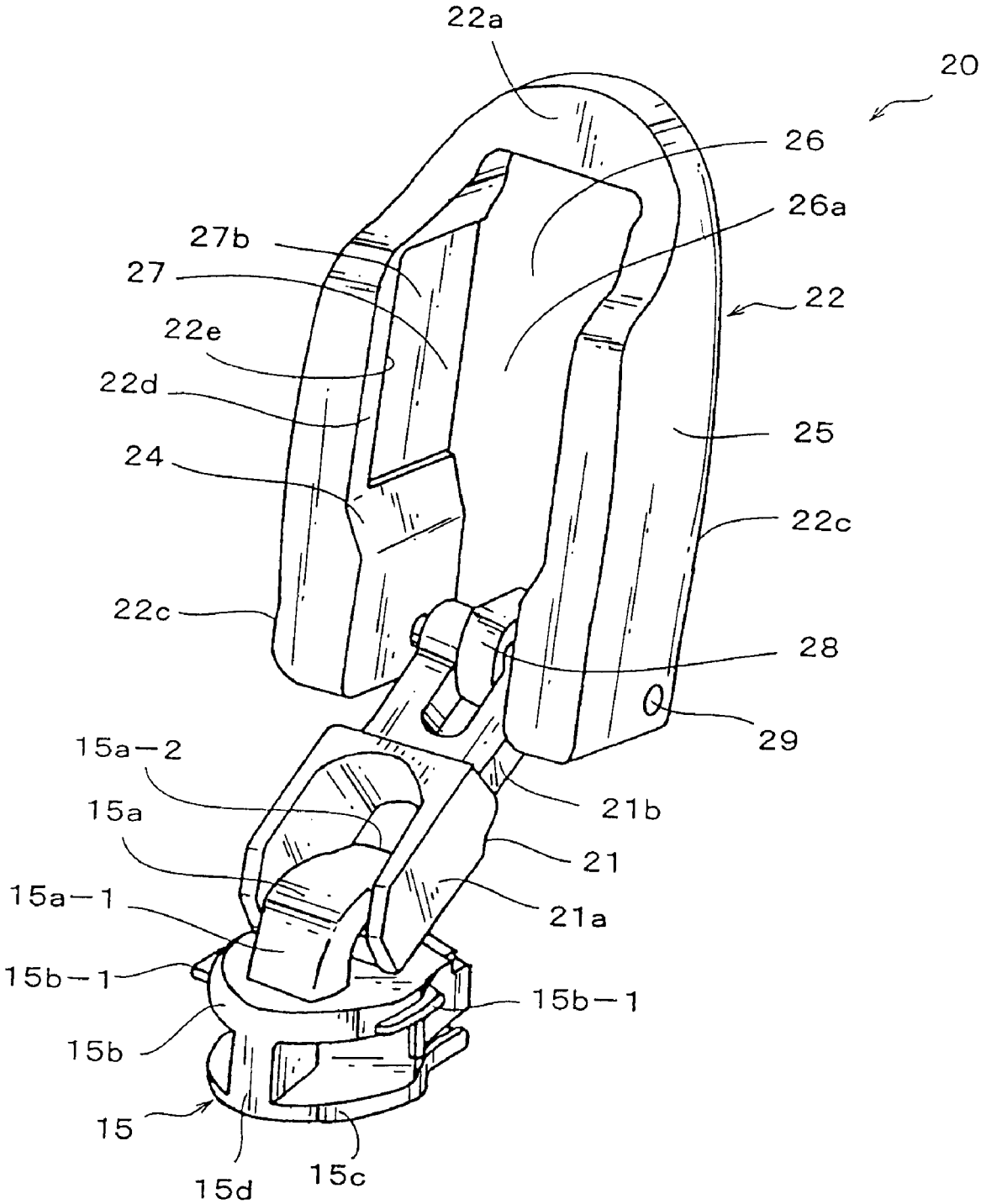
FIG. 14 is a perspective view taken along the line XIV-XIV in FIG. 13.

FIGS. 12 to 14 show a third embodiment of a zipper pull according to the invention. Meanwhile, in these drawings, the members that are substantially identical with the above described each embodiment are provided with the same member names and the same reference marks or numerals. According to the third embodiment, the recesses 27 of the cover member 22 and the projecting row portions 21*c* are excluded, protrusions 15*a*-3, 15*a*-3 are protruded from the right and left side surfaces of the front end portion 15*a*-1, and concave portions 22*f*, 22*f* are formed on the opposed surfaces of the right and left side wall portions 22*c* corresponding to the protrusions 15*a*-3. Accordingly, the protrusions and the concave portions as the right and left movement interruption means is set properly, so that the engagement between the cover member 22 and the pull attaching post 15*a* is carried our securely, and the sufficient holding power between the component parts is obtained.

In the third embodiment, when the zipper pull 20 is positioned at the above described first position, the engagement between the cover member 22 and the pull attaching post 15*a* is not deviated and at the same time, the cover member 22 and the pull-tub 21 are not moved in the right and left directions, the up-and-down direction, and the back and forth directions. Meanwhile, in the third embodiment, it is of course that the zipper pull comprises the projecting row portions or the protrusions formed at the inside opposed surfaces and engaging stepped portion or the engaging concave portions formed at the right and left side surfaces of the post portion 15*a*-1.

Further, in the third embodiment, the recesses 27 of the cover member 22 and the projecting row portions 21*c* of the pull-tub 21 are excluded, but the invention is not limited by the illustrated examples. That is, the recesses 27 and the projecting row portions 21*c* may be provided, as well as the protrusions 15*a*-3 of the pull attaching post 15*a* and the concave portions 22*f* are provided. In this case, three members of the pull attaching post 15*a*, the pull-tub 21, and the cover member 22 are engaged completely, so that backlash and deviation among the component parts can be prevented completely, and the respective parts are supported and fixed firmly and securely.

Figure 15:
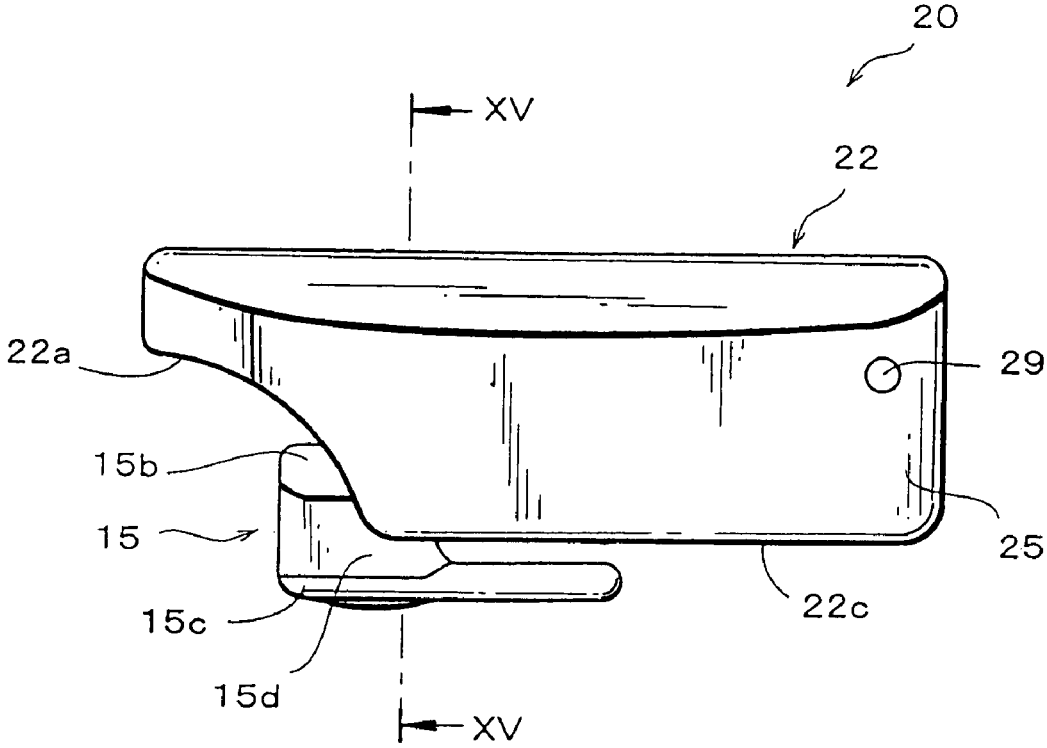
FIG. 15 is a side view of the assembly.
Figure 16:
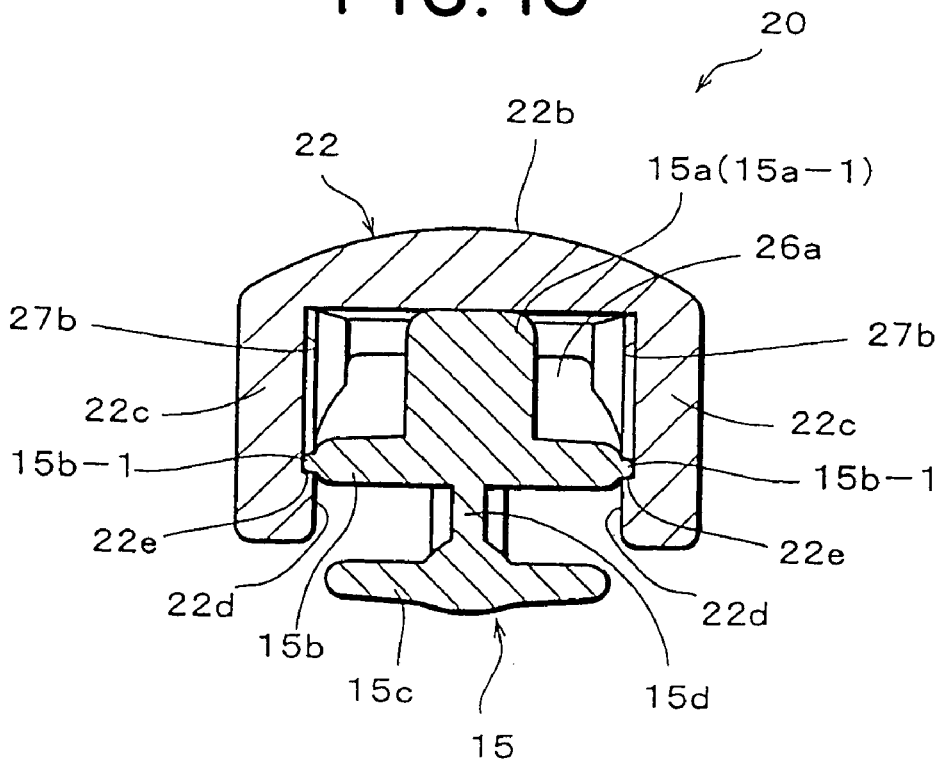
FIG. 16 is a sectional view on arrow taken along the line XV-XV in FIG. 15.

FIGS. 14 to 16 show a fourth embodiment according to the invention. Meanwhile, in these drawings, the members that are substantially identical with the above described each embodiment-s are provided with the same member names and the same reference marks or numerals. In the fourth embodiment, the right and left side wall portions 22*c* are extended from the upper plate 15*b* to the guide path for the engaging elements. As compared with the cover member 22 according to the above described first embodiment, the concave inner side surfaces 24 of the cover member 22 are enlarged so as to completely conceal the upper plate 15*b* together with the pull-tab 21.

Accordingly, the present embodiment is greatly different from the above described each embodiment in that the projecting row portions 21*c* of the pull-tab 21 are excluded, the right and left side wall portions 22*c* of the cover member 22 are fitted and engaged in the right and left end portions of the upper plate 15*b*, and then it is constituting the moving interruption means for interrupting the relative movement of the slider body 15 and the cover member 22 in any directions.

According to the illustrated examples, at part of the right and left end portions of the upper plate 15*b*, the projecting row portions 15*b*-1 are formed, respectively. At the inner surfaces of the right and left side wall portions 22*c* of the one cover member 22, engaging concave portions 27*b* each having rectangular cross section are formed respectively, the engaging concave portions being fitted in and be supported at the projecting row portions 15*b*-1, respectively. Further, the lower end portions of the inner surfaces of the right and left side wall portions 22*c* form stepped portions each having a guiding slid surface 22*d* and an engaging stepped portion 22*e*. This engaging concave portion 27*b* is formed so as to be flush with the recess 27 of the cover member 22 and constitutes part of the receptacle 26*a*.

The moving interruption means as one of main mechanisms of the zipper pull 20 according to this fourth embodiment comprises the projecting row portion 15*b*-1 and the engaging concave portion 27*b* so as to interrupt the relative movement of the slider body 15 and the cover member 22 in any directions. Adopting such a moving interruption means, the enough holding power of the cover member 22 and the pull tab 21 can be obtained while suppressing the swinging of the pull tab 21. Further, it is a matter of course that, in place of the projecting row portion 15*b*-1, protrusions can be formed intermittently on the right and left end surfaces of the upper plate 15*b*.

Figure 17:
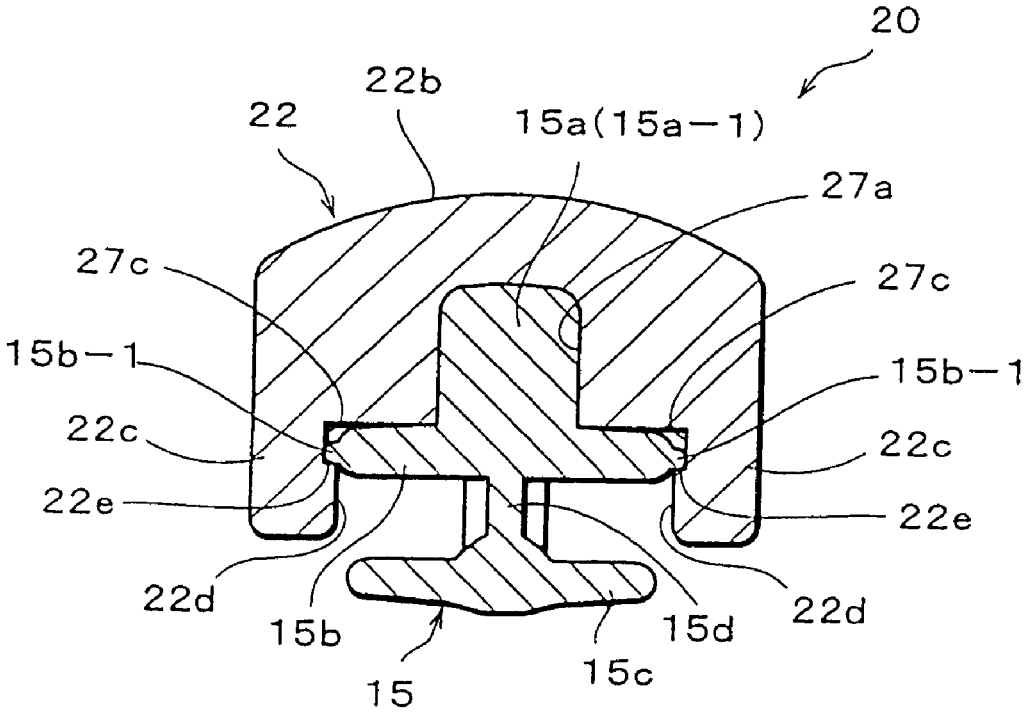
FIG. 17 is a sectional view showing a modified example of the assembly corresponding to FIG. 16.
Figure 18:
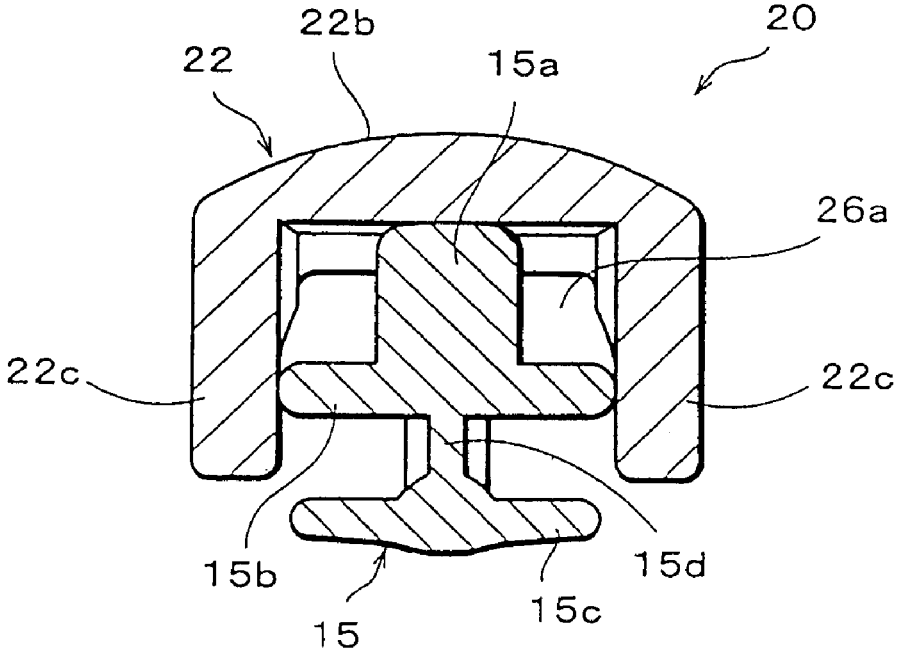
FIG. 18 is a sectional view showing another modified example of the assembly.
Figure 19:
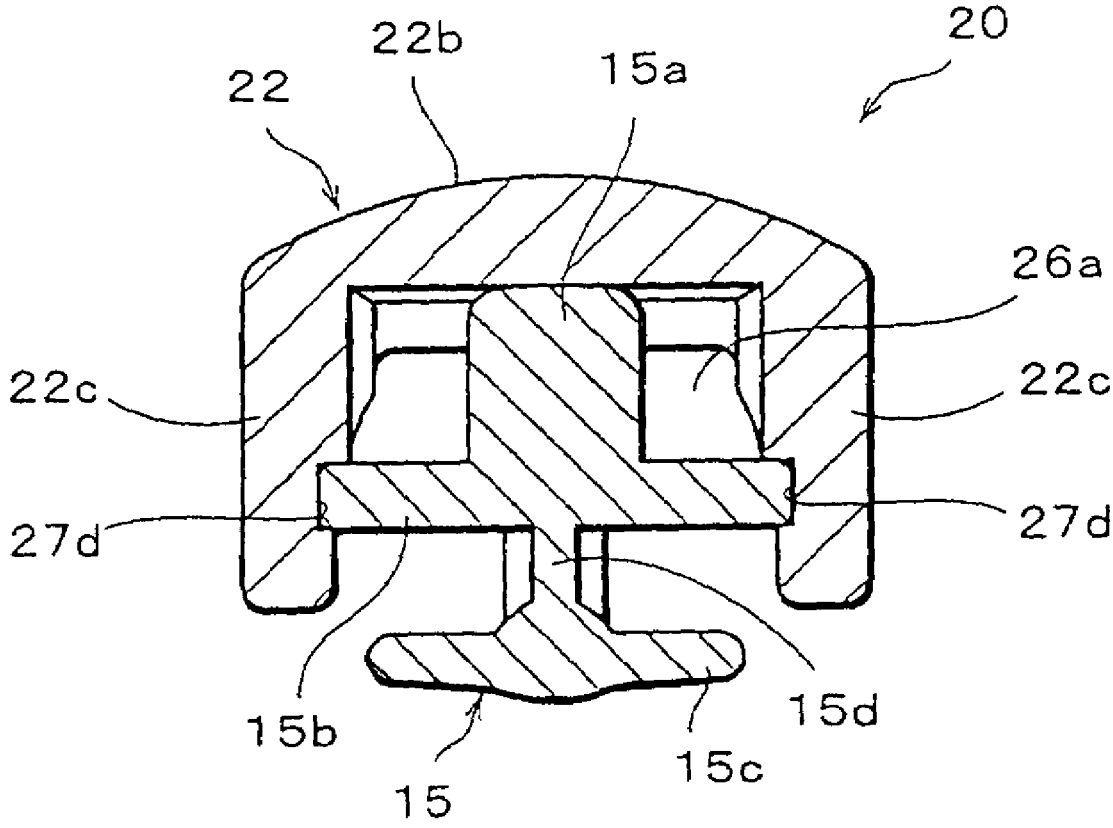
FIG. 19 is a sectional view showing another modified example of the assembly.

FIGS. 17 to 19 show first to third modified examples of a zipper pull according to the present invention, respectively. Meanwhile, in these drawings, the members that are substantially identical with the above described each embodiment are provided with the same member names and the same reference marks or numerals.

The first modified example shown in FIG. 17 is identical with the above described fourth embodiment in that a part of the slider body 15 together with the pull-tab 21 are completely concealed. However, it is greatly different from the above described fourth embodiment in that, on the inner surface of the upper wall portion 22*b* of the cover member 22, at least rectangular fitting concave portion 27*a* is formed to be fitted and be supported at the front end post portion 15*a*-1 of the pull attaching post 15*a*, on each if the inner surfaces of its right and left side wall portions 22*c*, an engaging concave portion 27*c* having the rectangular cross section corresponding to the lower end opening peripheral surface of the engaging concave portion 27*a* is formed, and on part of the end portion of one upper plate 15*b*, the projecting row portion 15*b*-1 to be fitted and engaged into the engaging concave portion 27*c* is formed, respectively.

Also, according to this first modified example, by using the soft material of the cover member 22, the pull-tab 21 and the slider body 15 are easily engaged with and disengaged from the receptacles 26, 26*a* from the first position toward the second position. In addition, adopting such a moving interruption means, it is possible to sufficiently secure the fixing area of the slider body 15 and the cover member 22.

The second modified example shown in FIG. 18 is greatly different from the above described each embodiment and the above described first modified example in that, with excluding the projecting row portions 15*b*-1 of the upper plate 15*b* and the fitting concave portion 27*a* of the right and left side wall portions 22*c*, the right and left end portions of the upper plate 15*b* are directly fitted in and engaged with the inner side surfaces 24 of the right and left side wall portions 22*c* of the cover member 22. With the moving interruption means having such a simple structure, without revealing a particular fixing member at the outside of the cover member 22 and the slider body 15, the cover member 20 and the pull-tab 21 are not moved in any directions and it is possible to enhance the holding power against the slider body 15.

In addition, according to the third modified example shown in FIG. 19, the lateral width dimension of the upper plate 15*b* in the right and left directions is set to be larger than the lower plate 15*c*, and as well, an engaging concave portion 27*d* to be fitted and fixed to each of the right and left end portions of the upper plate 15*b* is formed throughout part of the inner surface of each of the right and left side wall portions 22*c* of the cover member 22. With these structures, similarly to the above described each modified example, the cover member 22 can be accurately guided toward the right and left end portions of the upper plate 15*b* and further, between the opposed surfaces of the right and left side wall portions 22*c* of the cover member 22, the right and left end portions of the upper plate 15*b* can be simply and accurately engaged.

In this way, the configuration of the moving interruption means can be appropriately set depending on the shape, size and the like of the cover member 22 and the slider body 15. According to the above described fourth embodiment and the first to third modified examples, for example, fitting holes (not illustrated) may be formed at the right and left end surfaces of the upper plate 15*b* and projections (not illustrated) to be fitted into the fitting holes may be formed on the inner side surfaces 24 of the right and left side wall portions 22*c* of the cover member 22. It is a matter of course that these fitting holes and projections can be formed with appropriately combined with the right and left end surfaces of the upper plate 15*b* and the inner side surfaces 24 of the right and left side wall portions 22*c* of the cover member 22.

As described above, the preferable embodiments and modified examples according to the invention are exemplified. For example, according to the above described each embodiment and each modified example, as one example of the moving interruption means, a constructional example such that the pull attaching post 15*a* and the fitting concave portion 27*a* of the cover member 22 are fitted with each other, a constructional example such that the engaging concave portions 27*b*, 27*d* of the cover member 22 are resiliently fitted to the right and left end portions of the upper plate 15*b*, a constructional example such that the projecting row portions 15*b*-1 of the upper wing plate 15*b* are arranged, and further, the engaging concave portion 27*c* of the cover member, which is resiliently engaged with the projecting row portions 15*b*-1 of the cover member 22, and the like are exemplified. However, it is a matter of course that the object of the invention can be sufficiently achieved by any one of the moving interruption means or arbitrary combination thereof in relation to the other factors such as the configurations and the sizes of the slider body 15 and the pull attaching post 15*a*. Further, it is possible to form the projection and the engaging concave portion at the pull attaching post 15*a* and the fitting concave portion 27*a* of the cover member 22.

In addition, according to the invention, the configuration of the cover member is not particularly defined, and as a configuration of the cover member, the right and left side wall portions of the cover member may be formed as a flat wall surfaces as described above, and the right and left side wall portions of the cover member may be formed as wall portions each having a smoothly and outwardly curved convex surface. Accordingly, it is a matter of course that the present invention is not limited to the above described embodiments and modified examples, and the design of the invention may be variously varied within a scope that is recited in each claim.

What is claimed is:

1. A zipper pull comprising: a slider body, which is fixed to respective portions of an article, and selectively engages and disengages opposed engaging elements of a pair of co-operating zipper stringers by operation of the zipper pull; a pull-tab movably connected to the slider body and made of rigid material; and a cover member connected to the pull-tab and made movable between a first position in which the pull-tab is concealed in an immovable state and a second position in which the pull-tab is revealed, wherein the cover member has a shape so as to prevent a condition that the pull-tab substantially and directly contacts adjoining portions of the article at the first position, wherein an inner side surface of said cover member has a receptacle for receiving and holding at least the pull-tab or a part of the slider body, and has moving interruption means for preventing a relative movement of the slider body and the cover member at a first position, and wherein the slider body has a pull attaching post on a part of an upper surface of the slider body, and the pull attaching post is retained in the receptacle by said moving interruption means.

2. A zipper pull according to claim 1, wherein the receptacle of the cover member has an entrance passage having a size smaller than a corresponding dimension of the pull-tab and the pull-tab is firmly fitted in the receptacle through the entrance passage.

3. A zipper pull according to claim 1, wherein an outer side surface in a longitudinal direction of the cover member has a convex curved surface.

4. A zipper pull according to claim 1 or 3, wherein the cover member is essentially shell-shaped, and its inner side surface is a concave curved surface facing the pull-tab.

5. A zipper pull according to claim 4, wherein the cover member has an essentially C-shaped transverse cross section.

6. A zipper pull according to claim 1, wherein the cover member has an end portion which at a first position axially protrudes with respect to the pull-tab and the slider body and is manually grasped by a user to displace the cover member from the first position.

7. A zipper pull according to claim 6, wherein the end portion of the cover member is longitudinally tapered.

8. A zipper pull according to claim 6 or claim 7, wherein the end portion of the cover member has a tapered side surface.

9. A zipper pull according to claim 1, wherein the cover member is made of soft plastics or rubber material.

10. A zipper pull according to claim 1, wherein the pull-tab has a first end portion that is connected to said slider body;

the cover member has an upper wall portion and right and left side wall portions and is connected to a second end portion of the pull-tab, which is at an opposite side of the first end portion; and the moving interruption means for preventing a relative movement of the slider body and the cover member is provided at a part of the receptacle of the cover member.

11. A zipper pull according to claim 10, wherein a fitting concave portion to be engaged with an upper end portion of the pull attaching post is provided on an inner surface of an upper wall portion of the cover member.

12. A zipper pull according to claim 10, wherein the moving interruption means is provided at a part of right and left end portions of an upper wing plate of a slider body and the receptacle is provided at a part between opposed surfaces of right and left side wall portions of the cover member, and by the moving interruption means, the receptacle is fitted and supported at the part of the right and left end portions of the upper wing plate.

13. A zipper pull according to claim 12, wherein the moving interruption mewls are formed on the opposed surfaces of the right and left side wall portions of the cover member and the right and left end surfaces of the slider body, respectively, and the moving interruption means has a projection portion or a concave portion to be fitted with each other.

14. A zipper pull according to claim 1, wherein the cover member is hingedly connected to the pull-tab.

15. A zipper pull according to claim 1, wherein the pull-tab has a first end connected to the slider body, and the cover member is connected to a second end of the pull-tab which is opposite to the first end, whereby at the second position the cover member has an extended portion of the pull-tab to be grasped by a user.

* * * * *